US010857811B2

(12) United States Patent
Alacar

(10) Patent No.: US 10,857,811 B2
(45) Date of Patent: Dec. 8, 2020

(54) MARKING AN ORGANIZATION OF PAPERS

(71) Applicant: KYOCERA Document Solutions, Inc., Osaka (JP)

(72) Inventor: Arthur Alacar, Pacheco, CA (US)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 16/258,990

(22) Filed: Jan. 28, 2019

(65) Prior Publication Data

US 2020/0238727 A1 Jul. 30, 2020

(51) Int. Cl.

| | |
|---|---|
| ***B41J 3/01*** | (2006.01) |
| *B65H 3/32* | (2006.01) |
| *B65H 1/02* | (2006.01) |
| *B41J 11/00* | (2006.01) |

(52) U.S. Cl.

CPC ..... *B41J 3/01* (2013.01); *B41J 11/008* (2013.01); *B65H 1/02* (2013.01); *B65H 3/325* (2013.01)

(58) Field of Classification Search

CPC ..... B41J 3/01; B41J 11/008; B65H 3/325; B65H 1/02

See application file for complete search history.

(56) References Cited

U.S. PATENT DOCUMENTS

| | | | | |
|---|---|---|---|---|
| 4,757,348 | A * | 7/1988 | Rourke | G03G 15/507 347/139 |
| 7,734,218 | B2 | 6/2010 | Oohata | |
| 8,590,775 | B2 | 11/2013 | Hamada | |
| 8,625,129 | B2 * | 1/2014 | Noy | G06F 3/1204 358/1.15 |
| 9,053,396 | B2 | 6/2015 | Schierholz | |
| 9,152,354 | B2 | 10/2015 | Yuki | |
| 9,288,339 | B2 | 3/2016 | Kaneko | |
| 10,048,627 | B2 | 8/2018 | Sato | |

* cited by examiner

*Primary Examiner* — Justin Seo
(74) *Attorney, Agent, or Firm* — W. Eric Webostad

(57) ABSTRACT

Apparatus(es) and method(s) relating generally to marking an organization of papers. In one such method, obtained is a printer configured to print a stack barcode with a diagonal bar to provide a progression of page position indicators. The stack barcode is printed with the progression of the position indicators along edges of the papers in a stack to provide a line of the position indicators for the diagonal bar along a side of the stack. In one such apparatus, a printer is configured to print a stack barcode with a progression of position indicators. The printer is configured to print the stack barcode with the progression of the position indicators along edges of the papers in a stack to provide a line of the position indicators.

18 Claims, 5 Drawing Sheets

MARKING AN ORGANIZATION OF PAPERS

TECHNICAL FIELD

The following description relates to marking an organization of papers. More particularly, the following description relates to marking a stack of papers to provide an indication of an organization thereof.

BACKGROUND

At paper document scanning warehouses, documents are conventionally piled in batches. These documents may be grouped according to one or more criteria, such as by date-time, period in a day, originating location, originating company, document type, content classification, and/or other criteria. In addition to one or more of these criteria, position of each paper sheet within a group, such as a stack, may indicate a processing or other priority.

Conventional scanning processing in warehouse document scanning involves careful handling practices to avoid changes in order of sheets in a stack, co-mingling of batches, and/or other organizational and/or priority errors. However, these document scanning practices may force a one-worker per batch restriction to preserve order of paper documents and may impose other practices which likewise may slow a scanning process and/or increase costs.

SUMMARY

A method relates generally to marking an organization of papers. In such a method, obtained is a printer configured to print a stack barcode with a diagonal bar to provide a progression of page position indicators. The stack barcode is printed with the progression of the position indicators along edges of the papers in a stack to provide a line of the position indicators for the diagonal bar along a side of the stack.

An apparatus relates generally to marking an organization of papers. In such an apparatus, a printer is configured to print a stack barcode with a progression of position indicators. The printer is configured to print the stack barcode with the progression of the position indicators along edges of the papers in a stack to provide a line of the position indicators.

A scanning system relates generally to marking an organization of papers. In such a system, a conveyor is for receipt and conveying of a stack of papers. A printing subsystem has a printer configured to print a stack barcode with a progression of position indicators. The printer is configured to print the stack barcode with the progression of the position indicators along edges of the papers in the stack to provide a line of the position indicators. A scanner is configured to receive pages of the stack each with a portion of the stack barcode for scanning the papers to identify an order of the papers responsive to the stack barcode. A finisher is configured to put the papers of the stack in the order responsive to the stack barcode.

Other features will be recognized from consideration of the Detailed Description and Claims, which follow.

BRIEF DESCRIPTION OF THE DRAWINGS

Accompanying drawings show exemplary apparatus(es) and/or method(s). However, the accompanying drawings should not be taken to limit the scope of the claims, but are for explanation and understanding only.

FIGS. 6-1 and 6-2 are respective block-perspective view diagrams depicting examples of a printer for printing along a side of a stack.

DETAILED DESCRIPTION

In the following description, numerous specific details are set forth to provide a more thorough description of the specific examples described herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same number labels are used in different diagrams to refer to the same items; however, in alternative examples the items may be different.

Exemplary apparatus(es) and/or method(s) are described herein. It should be understood that the word "exemplary" is used herein to mean "serving as an example, instance, or illustration." Any example or feature described herein as "exemplary" is not necessarily to be construed as preferred or advantageous over other examples or features.

Reference will now be made in detail to examples which are illustrated in the accompanying drawings. In the following detailed description, numerous specific details are set forth in order to provide a thorough understanding of the following described implementation examples. It should be apparent, however, to one skilled in the art, that the implementation examples described below may be practiced without all the specific details given below. Moreover, the example implementations are not intended to be exhaustive or to limit scope of this disclosure to the precise forms disclosed, and modifications and variations are possible in light of the following teachings or may be acquired from practicing one or more of the teachings hereof. The implementation examples were chosen and described in order to best explain principles and practical applications of the teachings hereof to enable others skilled in the art to utilize one or more of such teachings in various implementation examples and with various modifications as are suited to the particular use contemplated. In other instances, well-known methods, procedures, components, circuits, and/or networks have not been described in detail so as not to unnecessarily obscure the described implementation examples.

For purposes of explanation, specific nomenclature is set forth to provide a thorough understanding of the various concepts disclosed herein. However, the terminology used herein is for the purpose of describing particular examples only and is not intended to be limiting. As used herein, the singular forms "a", "an" and "the" are intended to include the plural forms as well, unless the context clearly indicates otherwise.

Figure 1:
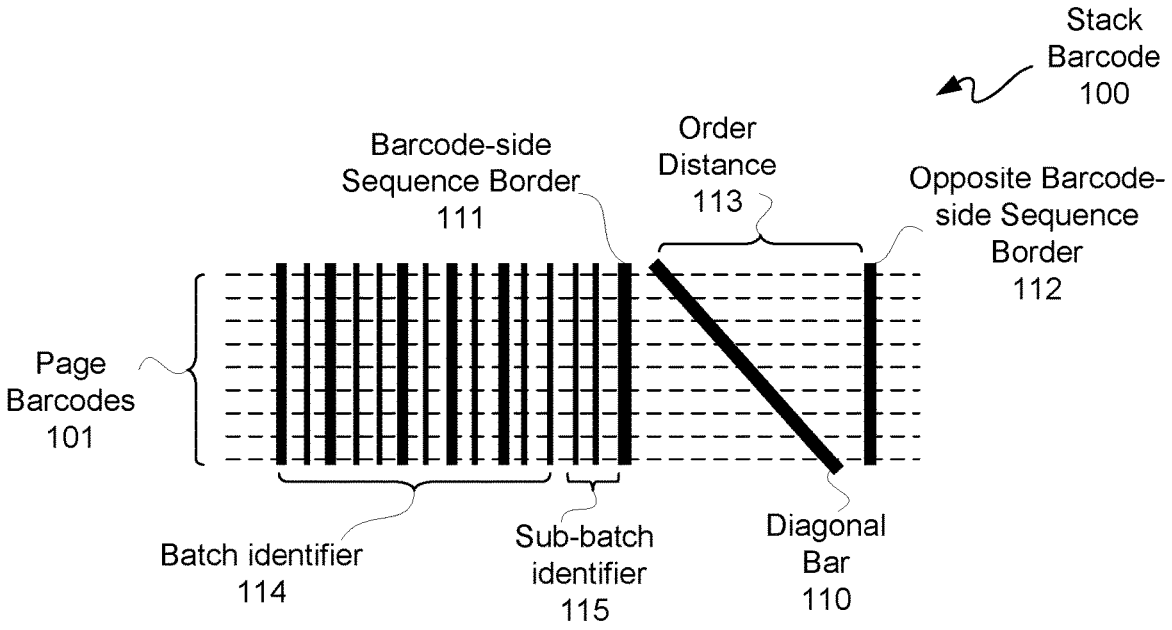
FIG. 1 is a top down view depicting an example of a stack barcode.

FIG. 1 is a top down view depicting an example of a stack barcode 100. Stack barcode 100 may include a batch identifier 114 and a diagonal bar 110. Stack barcode 100 may be printed along a side of a stack of papers to provide page barcodes 101 on edges of such papers.

Optionally, stack barcode 100 may include one or more of a sub-batch identifier 115, a barcode-side sequence border ("left-side sequence border") 111, and/or an opposite barcode-side sequence border ("right-side sequence border") 112. Distance 113 between a page position portion of diagonal bar 110 and right-side sequence border 112, and/or a left-side sequence border 111, may indicate a sequence order of a paper sheet associated with such page position in a stack of papers, such as for a document batch.

Batch identifier 114 may be a series of numbers to indicate for example a series of documents and/or groupings of documents. A sub-batch identifier 115 may indicate a series of documents within a batch of documents associated with a batch identifier 114.

Figure 2:
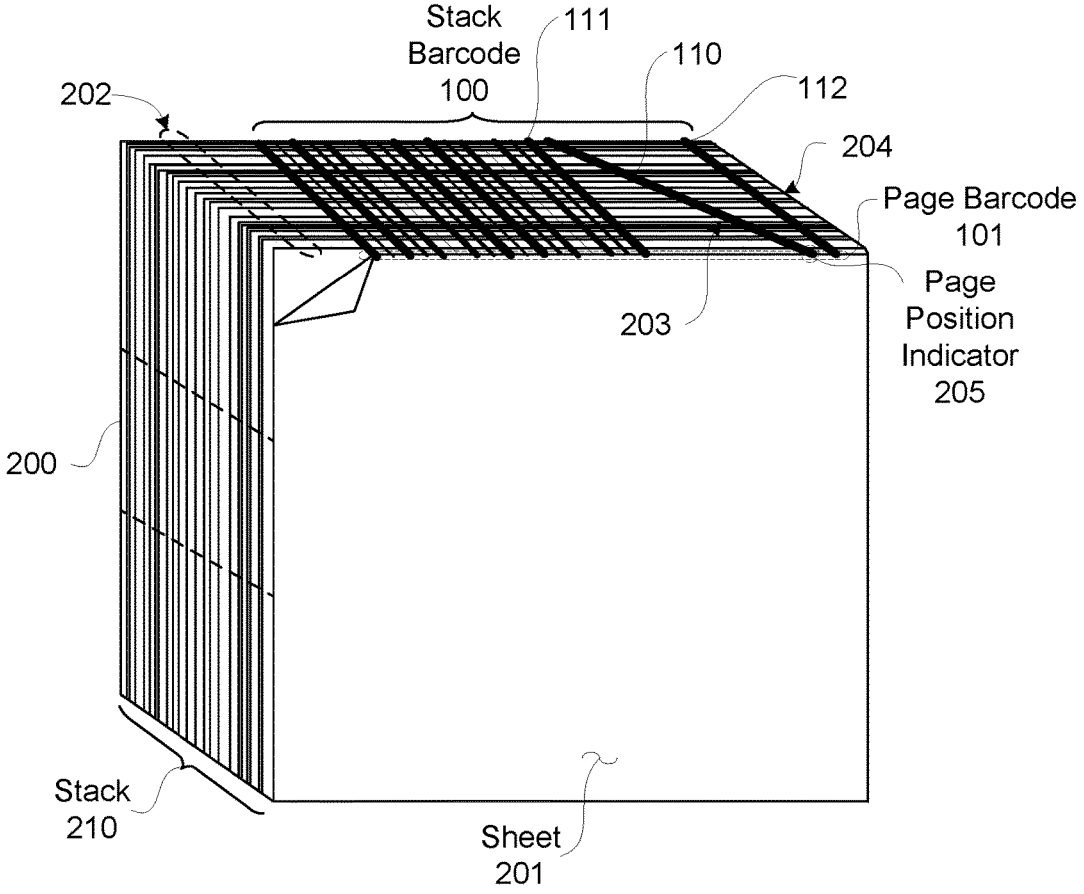
FIG. 2 is a perspective view depicting an example of a stack of papers marked with a stack barcode.
Figure 3:
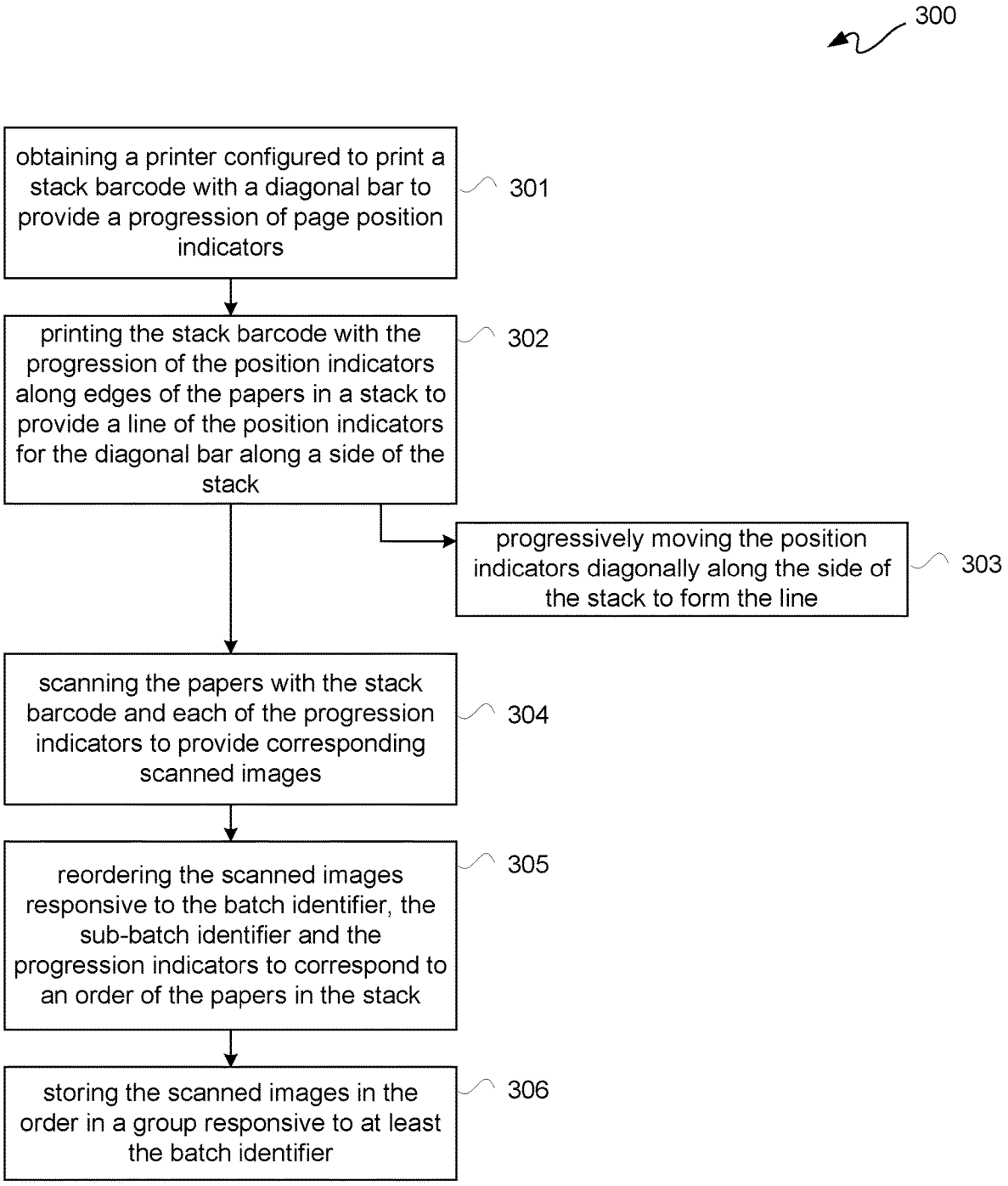
FIG. 3 is a flow diagram depicting an example of a document marking flow for marking an organization of papers.

Diagonal bar 110 provides progression indicators on pages associated with page barcodes 101. Along those lines, FIG. 2 is a perspective view depicting an example of a stack 210 of papers marked with a stack barcode 100. FIG. 3 is a flow diagram depicting an example of a document marking flow 300 for marking an organization of papers. Stack 210 and document marking flow 300 are further described together with simultaneous reference to FIGS. 1 through 3.

At operation 301, a printer is obtained. Such printer is or may be configured to print a stack barcode 100 with a diagonal bar 110 to provide a progression of page position indicators 205. A printer configured to print a stack barcode is described below in additional detail.

At operation 302, stack barcode 100, including diagonal bar 110, is printed along edges 204 of sheets 201 of papers in a stack 210 to provide a progression of position indicators 205 forming a line 203 along a side 202 of stack 210. In this example, line 203 is a diagonal bar 110. However, in another example, a more jagged or stepped line generally diagonally or other geometric indexing may be used.

In this example, a side 202 is a top side of stack 210. However, in another example, a side, other than a top side, 202 may be used. Furthermore, optionally another stack barcode 100 may be printed on a same or different side of stack 210, such as for example as generally indicated with a dashed box 200.

A printing operation 302 may include an operation 303 to progressively move position indicators 205 diagonally along a side 202 of stack 210 to form line 203, which in this example is a diagonal bar 110. In this example, a printhead or a portion thereof, such as for example of an inkjet or other type of printer, may be moved relative to edges of papers along a side 202. Such movement may be responsive to movement of a printer relative to side 202. Such printing operation 302 may further include printing a second stack barcode 100 with a second progression of second position indicators 205, as described below in additional detail.

Stack barcode 100 may include a batch identifier 114 and a sub-batch identifier 115, the latter of which may be reset to print along a taller and/or narrower side 202. For example, a printer may be a hand-held inkjet printer. Such hand-held inkjet printer may be configured to increment sub-batch identifier 115 and to reset progression of position indicators 205. For example, if a stack 210 is too tall for a single diagonal bar 110, a printer may be configured after printing a first diagonal bar 110 to increment a sub-batch identifier 115 and to continue printing with another diagonal bar 110.

Figure 4:
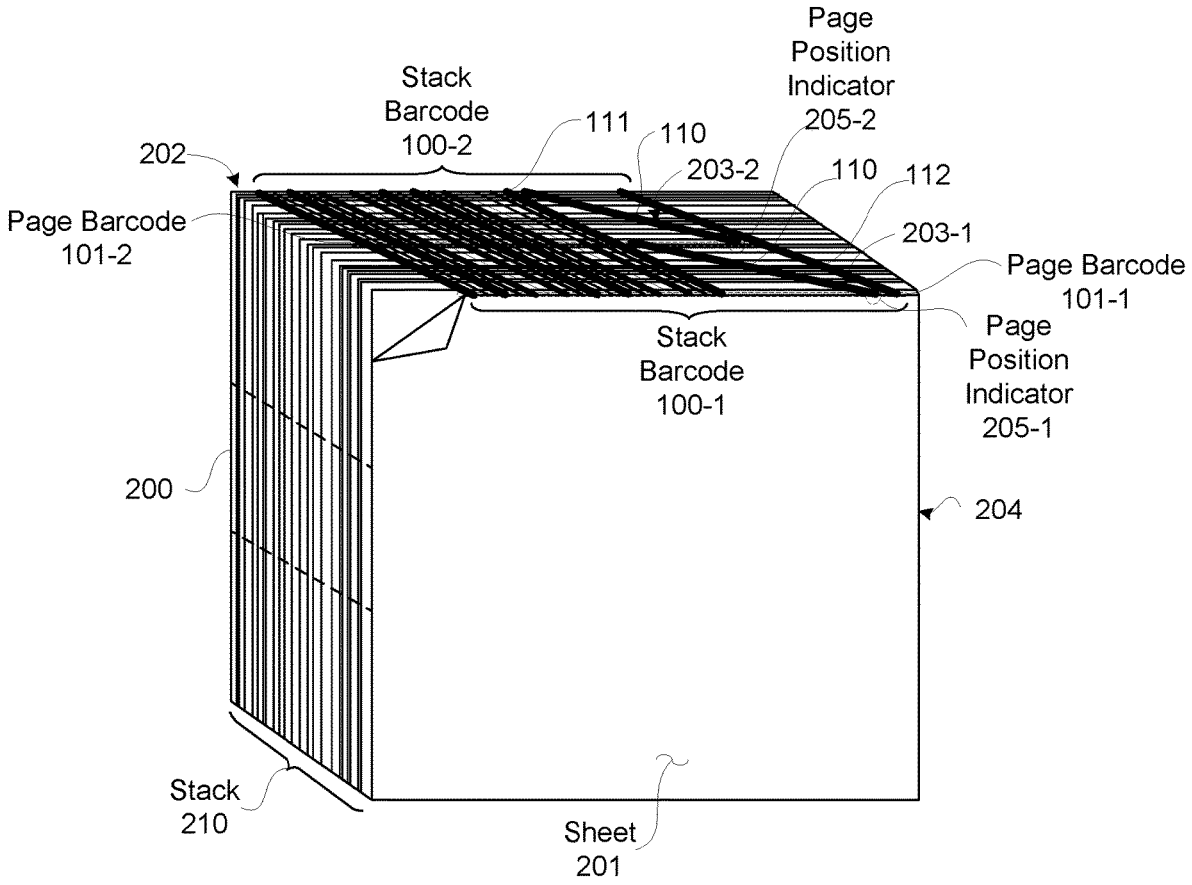
FIG. 4 is a perspective view depicting another example of a stack of papers marked with a first stack barcode and a second stack barcode.

Along those lines, FIG. 4 is a perspective view depicting another example of a stack 210 of papers marked with a first stack barcode 100-1 and a second stack barcode 100-2. Such stack 210 is further described with simultaneous reference to FIGS. 1 through 4; however, as many of the details have previously been described, generally such description is not repeated for purposes of clarity and not limitation.

Such first stack barcode 100-1 may be printed on side 202 with a batch identifier 114, a first sub-batch identifier 115, and a diagonal bar 110. Such printing may be continued with a second stack barcode 100-1 with a same batch identifier 114, a second sub-batch identifier 115 incremented from such first sub-batch identifier 115, and another instance of a diagonal bar 110.

Such a printer obtained at 301 may be configured to print a right-side sequence-side sequence border 112 and a left-side sequence-side sequence border 111 with printing of a progression of position indicators 205 of diagonal bar 110. Such a progression of position indicators 205 may be printed between right-side sequence border 112 and left-side sequence border 111, which may be used to provide lines 203. In other words, such sequence borders 111 and 112 may be the same in stack barcodes 100-1 and 100-2. Optionally, stack barcodes 100-1 and 100-2 may indicate different priorities for purposes of order of scanning documents.

A first set of position indicators 205-1 for first page barcodes 101-1 is printed with a first stack barcode 100-1 having a first line 203-1 along first edges of sheets 201 on side 202. A second set of position indicators 205-2 for second page barcodes 101-2 is printed with a second stack barcode 100-2 having a second line 203-2 along second edges of sheets 201 on side 202.

Figure 5:
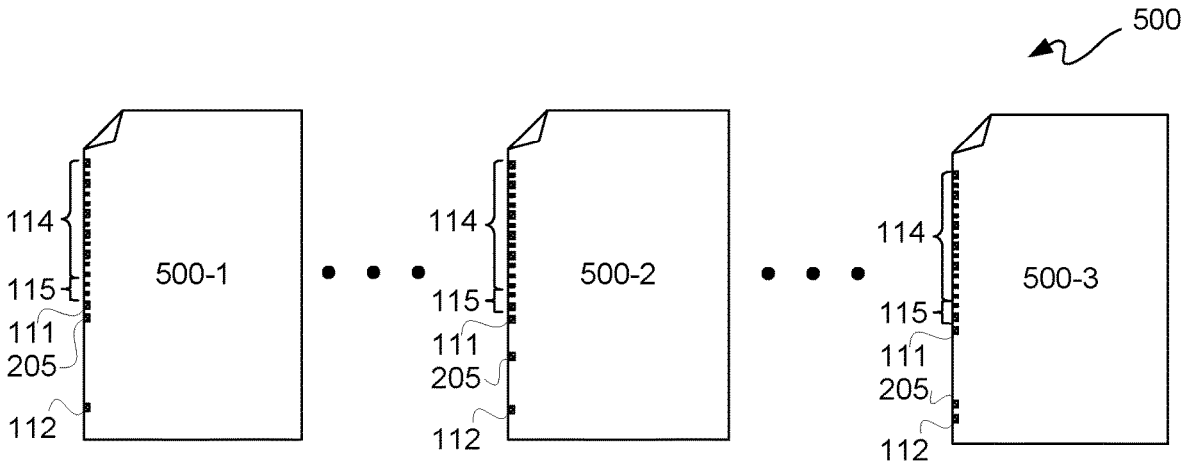
FIG. 5 is a pictorial sequence diagram depicting an example of scanned images.

At operation 304, papers or sheets 201 with a stack barcode or stack barcodes 100 and hence progression indicators 205 may be scanned to provide corresponding scanned images. FIG. 5 is a pictorial sequence depicting an example of scanned images 500. Scanned images 500 are further described with simultaneous reference to FIGS. 1 through 5.

At operation 305, scanned images 500 may be automatically electronically reordered responsive to batch identifier 114, sub-batch identifier 115 and progression indicators 205 to correspond to an order of papers or sheets 201 in stack 210. A first scanned image 500-1 may have a batch identifier 114, a sub-batch identifier 115, a progression indicator 205 proximate with respect to a sequence border 111 and distal with respect to a sequence border 112. A subsequently scanned image 500-2 may have a batch identifier 114, a sub-batch identifier 115, a progression indicator 205 in a middle section between sequence borders 111 and 112. And a further subsequently scanned image 500-3 may have a batch identifier 114, a sub-batch identifier 115, a progression indicator 205 proximate with respect to a sequence border 112 and distal with respect to a sequence border 111.

At operation 306, scanned images 500 may be stored in order in a group responsive to at least batch identifier 114 and progression indicators 205. Therefore, if a stack 210 is printed with a stack barcode or stack barcodes 100, and such stack 210 is subsequently disturbed to be out of a stack order, then such scanned papers 500 may be reordered into such stack order automatically responsive to page barcodes 101.

Figures 1, 6:
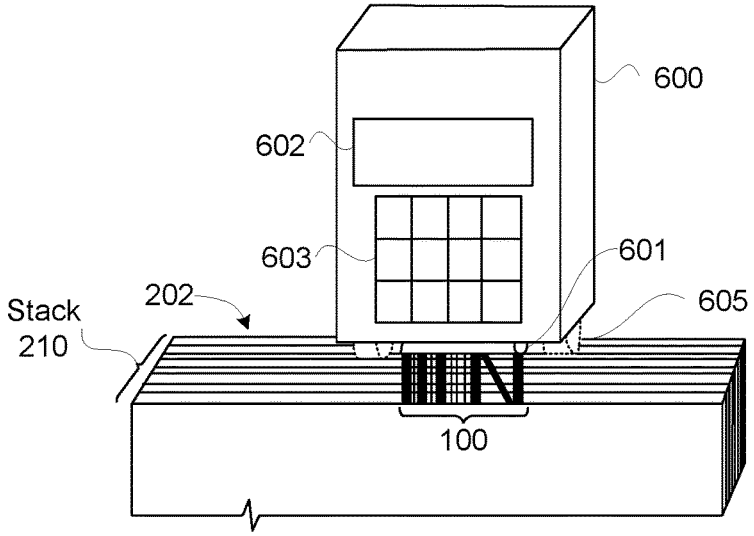
Figures 2, 6:
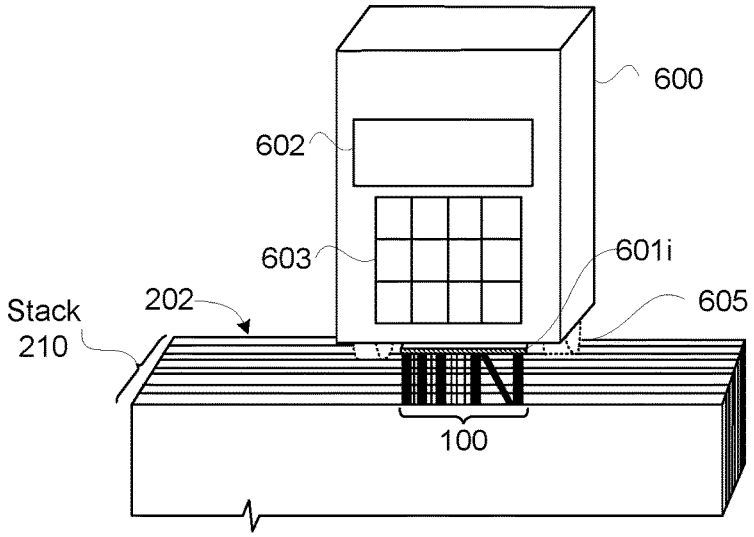

FIGS. 6-1 and 6-2 are respective block-perspective view diagrams depicting examples of a printer 600 for printing along a side 202 of a stack 210. Printer 600 may include a control panel 603 and a display 602, which details are not described in unnecessary detail. Printer 600 may have a roller 601 or may have another type of printhead. Roller 601 may have a settable barcode along with fixed sequence borders 111 and 112 and a diagonal bar 110 wrapped around roller 601. Length of such diagonal bar 110 may be a maximum height of a stack of papers. In another example, rather than a roller, an inkjet printhead 601*i* may be used. Optional guides, such as in this example guide wheels 605, may be disposed on opposing sides of a roller printhead 601 or an inkjet printhead 601*i*. With respect to the latter, guide wheels 605 may be used to keep an inkjet printhead 601*i* a fixed distance from a side 202 of a stack 210 or other grouping of papers. For example, an inkjet printhead 601*i* may move in an orthogonal direction with respect to a lateral orientation of inkjet printhead 601*i* to traverse a side of a stack 210. In another example, an inkjet printhead 601*i* may be oriented at an angle other than 90 degrees with respect to direction of movement of such inkjet printhead. An inkjet printhead used in inkjet printing is well-known, and thus not described in unnecessary detail herein. Other known details regarding printer 600 are not described herein for purposes of clarity and not limitation. Printer 600 is described further with simultaneous reference to FIGS. 1 through 6-2.

Printer 600 may be configured to print a stack barcode 100 with a progression of position indicators 205 provided by a diagonal bar 110. Printer 600 may be configured to print stack barcode 100 with a progression of position indicators 205 along edges of papers or sheets 201 in a stack 210 to provide a line 203 of position indicators 205.

Printer 600 may be configured with a roller printhead 601 or an inkjet printhead 601*i* for example. A roller printhead 601 or an inkjet printhead 601*i* may be used to print a diagonal stripe or bar 110. Such diagonal bar 110 may be printed from rotation of roller printhead 601 or with movement of inkjet printhead 601*i*. For example for rotation of roller printhead 601 used to print diagonal bar 110, at least one full or partial rotation circumferentially of such a roller printhead 601 may be used to print position indicators 205 progressively as roller printhead 601 is rotated alongside a side 202 of stack 210 to print line 203 diagonally on side 202 of stack 210. For example for an inkjet printhead 601*i*, such printhead 601*i* may have a width for printing one or more lines 203 diagonally on side 202 of stack 210, where such printhead 601*i* may electronically reset, including incrementing a barcode, responsive to exceeding a limit of printing a single continuous diagonal line of such printhead 601*i* to print another diagonal line in continuous succession, such as a zig-zag pattern, or in discontinuous succession, such as a repeat in whole or in part of an immediately previous diagonal line.

Printer 600 may be configured to increment sub-batch identifier 115 responsive to movement of a roller printhead 601 or an inkjet printhead 601*i* of printer 600. Printer 600 may be configured to reset progression of position indicators 205 responsive to movement of roller printhead 601, inkjet printhead 601*i*, or other printhead of printer 600.

In an example of an inkjet printhead 601*i*, movement of an inkjet printhead 601*i*, such as of an inkjet printer for example, along a side 202 of a stack 210 may be used to increment sub-batch identifier 115. In other words, a sub-batch identifier 115 may be incremented responsive to movement of an inkjet printhead 601*i* of printer 600. In such an example, printer 600 may be a hand-held inkjet printer.

Figure 7:
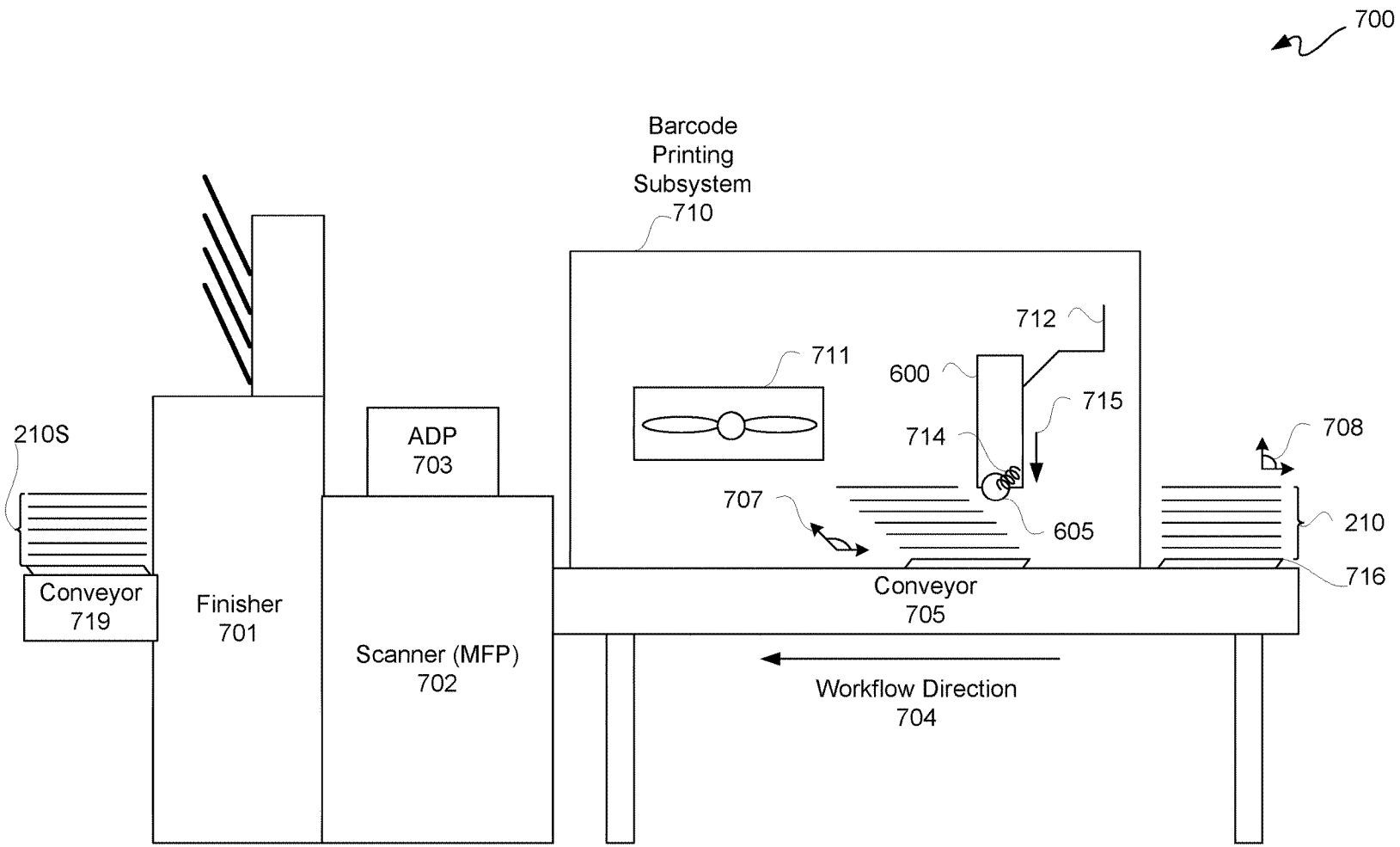
FIG. 7 is a block diagram depicting an exemplary scanning system.

FIG. 7 is a block diagram depicting an exemplary scanning system 700. Scanning system 700 is further described with simultaneous reference to FIGS. 1 through 7.

Scanning system 700 may include a conveyor 705, a barcode printing subsystem 710, a scanner 702, a finisher 701, and an automatic document processor/handler ("ADP") 703. Scanner 702 may be a standalone scanner, a multi-function peripheral ("MFP"), such as for example a multi-function printer or other multi-function product with a scanner. As finisher 701, scanner 702, and ADP 703 are well-known, such components of scanning system 700 are not described in unnecessary detail for purposes of clarity and not limitation.

A stack 210 of documents or other papers may be placed onto a pad 716 on a conveyor 705. Conveyor 705 may be implemented with a driven conveyor belt and/or rollers.

Stack 210 may be conveyed into barcode printing subsystem 710, such as in workflow direction 704, to have barcodes printed on edges of sheets thereof, such as previously described herein. Printing subsystem 710 includes printer 600 for printing such a barcode.

In this example, printer 600 includes a roller or inkjet printhead, such as described with reference to FIGS. 6-1 and 6-2, with optional guide wheels 605. Guide wheels 605 may be coupled to a spring tensioner 714 for maintaining engagement of with or proximate to a side 202 of stack 210.

Positioning and movement of printer 600 may be by hand held control or controlled with a robotic arm 712. Barcode printer 600 may be moved in a downward direction 715 alongside a stack 210. Printer 600 may be moved in such a downward direction 715, which may be orthogonal to conveyor 705, while a stack 210 of documents is moved in a left direction by conveyor 705, for printing barcodes. However, in another example, an angle other than 90 degrees may be used.

Along those lines, a stack 210 may have sheets thereof displaced in a leftward direction as in this example, so a printhead, in addition to being moved in a downward direction 715, may further be moved in workflow direction 704 with stack 210 for tracking therewith while being moved in downward direction 715. In another example, stack 210 may be moved to a print position within barcode printing subsystem 710, and then stayed at such location until printer 600 has completed printing a side of a stack 210.

In this example, a fan 711, such as used for inkjet printers, can be located after or downstream of printer 600. Fan 711 may be used for drying up printed ink along a side of stack 210. Along those lines, fan blades of fan 711 may be positioned for directing airflow onto a barcode print side of stack 210.

Each stack 210 of documents with barcodes printed thereon may be moved to scanner 702 to be scanned. Scanner 702, after scanning, may move such scanned documents to finisher 701. Once a stack 210 is completely barcode printed and scanned, namely stack 210S, finisher 701 may be used to load such scanned documents onto an output conveyor 719 to be returned for storage or other subsequent processing.

If, after printing a stack barcode 100 on a stack 210, such stack barcode 100 may be read via scanner 702. Scanner 702 may be configured to read information of a stack barcode 100 to electronically order or reorder sheets of a stack 210 to conform to such stack barcode 100. Accordingly, if a stack 210 is to be ordered or reordered after printing a stack barcode 100 thereon, a scanning by scanner 702 may be used to electronically order or reorder such images of sheets or pages in accordance with such stack barcode 100. Finisher 701 may be operated responsive to such information obtained by scanning a stack barcode 100 to physically order or reorder sheets of stack 210 corresponding to stack barcode 100.

While the foregoing describes exemplary apparatus(es) and/or method(s), other and further examples in accordance with the one or more aspects described herein may be devised without departing from the scope hereof, which is determined by the claims that follow and equivalents thereof. Claims listing steps do not imply any order of the steps. Trademarks are the property of their respective owners.

What is claimed is:

1. A method for marking an organization of papers, comprising:

obtaining a printer configured to print a stack barcode with a diagonal bar to provide a progression of page position indicators indicating a sequence order of papers in a stack; and printing the stack barcode with the progression of the position indicators along edges of the papers in the stack to provide a line of the position indicators for the diagonal bar along a side of the stack.

2. The method according to claim 1, wherein the printing includes progressively moving the position indicators diagonally along the side of the stack to form the line.

3. The method according to claim 2, wherein the printer is configured to print a right-side sequence border and a left-side sequence border with the printing of the progression of the position indicators.

4. The method according to claim 3, wherein the progression of the position indicators are printed between the right-side sequence border and the left-side sequence border.

5. The method according to claim 4, wherein the stack barcode includes a batch identifier and a sub-batch identifier.

6. The method according to claim 5, wherein the printer includes an inkjet printhead and is configured to increment the sub-batch identifier and to reset the progression of the position indicators.

7. The method according to claim 5, further comprising:

scanning the papers with the stack barcode and each of the progression indicators to provide corresponding scanned images;

reordering the scanned images responsive to the batch identifier, the sub-batch identifier and the progression indicators to correspond to the sequence order of the papers in the stack; and storing the scanned images in the sequence order in a group responsive to at least the batch identifier and the progression indicators.

8. The method according to claim 2, wherein:

the stack barcode is a first stack barcode;

the progression is a first progression;

the position indicators are first position indicators; and the method further comprising:

printing by the printer a second stack barcode with a second progression of second position indicators.

9. The method according to claim 8, wherein:

the edges are first edges;

the line is a first line;

the side of the stack is a first side of the stack; and the second stack barcode is printed with the second progression of the second position indicators along second edges of the papers in the stack to provide a second line of the second position indicators.

10. The method according to claim 9, wherein the second edges are different from the first edges.

11. The method according to claim 9, wherein the first stack barcode and the second stack barcode indicate different priorities.

12. An apparatus for marking an organization of papers, comprising:

a printer configured to print a stack barcode with a progression of position indicators;

the printer configured to print the stack barcode with the progression of the position indicators along edges of the papers in a stack to provide a line of the position indicators indicating a sequence order of the papers in the stack;

wherein the stack barcode includes a batch identifier and a sub-batch identifier; and wherein the printer is configured to increment the sub-batch identifier responsive to movement of a printhead of the printer with respect to a side of the stack.

13. The apparatus according to claim 12, wherein the printer is configured with a roller printhead to print a diagonal stripe for at least partial circumferential rotation of the roller printhead to print the position indicators progressively as the roller is rotated alongside a side of the stack to print the line diagonally on the side of the stack.

14. The apparatus according to claim 12, wherein the printer is configured to reset the progression of the position indicators responsive to movement of the printhead with respect to the side of the stack.

15. The apparatus according to claim 14, wherein the printer is configured with an inkjet printhead to print a diagonal stripe for at least a partial distance along the side of the stack to print the position indicators progressively as the inkjet printhead is moved up or down the side of the stack to print the line diagonally on the side of the stack.

16. The apparatus according to claim 12, wherein the printer is configured to print a right-side sequence border and a left-side sequence border for the progression of the position indicators.

17. A scanning system for marking an organization of papers, comprising:

a conveyor for receipt and conveying of a stack of papers;

a printing subsystem having a printer configured to print a stack barcode with a progression of position indicators;

the printer configured to print the stack barcode with the progression of the position indicators along edges of the papers in the stack to provide a line formed of the position indicators; and a scanner configured to receive pages of the stack each with a portion of the stack barcode and the position indicators for scanning the papers to identify a sequence order of the papers in the stack responsive to the stack barcode and the position indicators.

18. The scanning system according to claim 17, further comprising:

a finisher configured to physically put the papers of the stack in the sequence order responsive to the stack barcode;

a fan of the printing subsystem positioned after the printer for air drying the stack barcode on the stack; and wherein the scanner is of a multi-function peripheral.

* * * * *